US006259867B1

(12) United States Patent
Park et al.

(10) Patent No.: US 6,259,867 B1
(45) Date of Patent: Jul. 10, 2001

(54) TRANSFER JAM DETECTING APPARATUS FOR A WET TYPE ELECTROPHOTOGRAPHIC COLOR PRINTER

(75) Inventors: Woo-yong Park, Suwon; Min-soo Lee, Euiwang, both of (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/610,605

(22) Filed: Jul. 5, 2000

(30) Foreign Application Priority Data

Nov. 20, 1999 (KR) ..... 99-51747

(51) Int. Cl.[7] ..... G03G 15/00
(52) U.S. Cl. ..... 399/21; 271/258.01; 399/22
(58) Field of Search ..... 399/21, 9, 16, 399/18, 22, 307, 397, 400; 271/258.01, 258.03, 265.01

(56) References Cited

U.S. PATENT DOCUMENTS 5,943,524 * 8/1999 Eom ..... 399/18
5,970,274 * 10/1999 Rath ..... 399/21

FOREIGN PATENT DOCUMENTS 62-227776 * 10/1987 (JP) .

* cited by examiner

*Primary Examiner*—Arthur T. Grimley
*Assistant Examiner*—Hoan Tran
(74) *Attorney, Agent, or Firm*—Robert E. Bushnell, Esq.

(57) ABSTRACT

A transfer jam detecting apparatus for a wet type electrophotographic color printer capable of detecting various kinds of jams occurring at a transfer roller, including: a printed matter entrance sensor disposed on a front side of a transfer roll, for detecting an entrance of a printed matter into the transfer roll; a feed roll disposed by a shaft to be rotated in either direction on a transfer section printed matter guide disposed on a rear side of the transfer roll, the feed roll being passively rotated by the conveyed printed matter; a pressing roll assembly disposed on an upper portion of the feed roll, for pressing the printed matter in a manner that the feed roll is passively rotated by the conveyed printed matter; and feed roll rotational direction detecting section for detecting the presence of a jam by detecting the rotation and rotational direction of the feed roll. The feed roll rotational direction detecting section includes a rotational plate disposed on the shaft of the feed roll, and having a plurality of sensing holes; and a sensor disposed to receive the sensing holes of the rotational plate, for detecting the rotation and rotational direction of the rotational plate. Accordingly, all kinds of jams occurring at the transfer roll can be detected, precisely, and operation of the printer can be timely stopped. Since the kind of the jam is clearly indicated to a user, the user is enabled to prevent serious error in the related parts of the printer which is caused due to a wrap jam, and to remove the wrap-jammed printed matter easily.

19 Claims, 6 Drawing Sheets

TRANSFER JAM DETECTING APPARATUS FOR A WET TYPE ELECTROPHOTOGRAPHIC COLOR PRINTER

CLAIM OF PRIORITY

This application makes reference to, incorporates the same herein, and claims all benefits accruing under 35 U.S.C. §119 from my application APPARATUS FOR DETECTING TRANSFER JAM OF A LIQUID ELECTROPHOTOGRAPHIC COLOR PRINTER filed with the Korean Industrial Property Office on Nov. 20, 1999 and there duly assigned Ser. No. 51747/1999.

BACKGROUND OF THE INVENTION

1. Field of the Invention

The present invention relates to a wet type electrophotographic color printer, and more particularly to a detecting apparatus for a wet type electrophotographic color printer for detecting various kinds of transfer jams occurring in a transfer roll, and accordingly stopping the operation of the printer.

2. Description of the Prior Art

Generally, a wet type electrophotographic color printer prints a desired image by forming the electrostatic latent image through the processes of: radiating a laser beam to a photosensitive medium such as a photosensitive belt; developing the electrostatic latent image formed on the photosensitive medium with a developing solution composed of a solid toner of a certain color and a liquid carrier as a solvent; and transferring the developed form to printed matter.

Such a wet type electrophotographic color printer includes a photosensitive material in the form of a belt reeled to travel on rollers which are disposed within a printer body. Around the photosensitive material, a charged unit, an exposure unit, a developing unit, a drying unit, and a transferring/fixing unit, etc. are disposed.

The electrostatic latent image is formed on the photosensitive medium, to be developed by the developing unit. The developing unit develops the electrostatic latent image on the surface of the photosensitive medium by jetting the developing liquid, and exclusively retaining the toner of the developing liquid at the area of electrostatic latent image. The drying unit eliminates residue of the carrier left from the operation of the developing unit, to an extent acceptable for the transferring operation. The transferring/fixing unit transfers the image formed on the photosensitive medium onto the printed matter.

The printed matter is stored in a plurality of cassettes in accordance with the respective sizes and kinds thereof, and is fed to the transferring/fixing unit along a feeding path. After the image is printed on the printed matter which is passed through the transferring/fixing unit, the printed matter is stored in a distributing tray.

Here, while the printed matter is passed between the transfer and fuser rolls, various kinds of transfer jams may occur, that is, the printed matter may be wrapped around the transfer and fuser rolls due to various causes such as peel force increase in the transfer and fuser rolls, or a stain on the transfer and fuser rolls, etc.

When the above-described transfer jams occur, the printing is not properly performed due to the crumpled exit of the printed matter. Even worse, if the printer keeps operating in the state where the printed matter is wrapped around the transfer and fuser rolls, a serious error will result in the photosensitive material, the transfer roll, the fuser roll, and the photosensitive material driving section. In order to prevent such an error, the wet type electrophotographic color printer generally has a transfer jam detecting apparatus for stopping the operation of the printer upon detecting the presence of the transfer jam.

A conventional transfer jam detecting apparatus includes a first detecting lever, which can rotate in a forward or reverse direction, disposed on the printed matter conveying path after the transfer and fuser rolls, a second detecting lever which rotates in accordance with the rotation of the first detecting lever, and a sensor which is turned on/off in accordance with the rotation of the second detecting lever.

Here, the first detecting lever is rotated clockwise on a pin by making contact with the front end of the printed matter, thereby rotating clockwise the second detecting lever on a pin. After the clockwise rotation, the first and second detecting levers are returned to their initial position by their respective weights. The sensor is turned on by the rotation of the second detecting lever, thereby sensing the normal exit of the printed matter. If the sensor is not turned on by a certain period of time after the entrance of the printed matter into the transfer roll, it is sensed that a jam has occurred, and a signal is transmitted to a control section for stopping the operation. Accordingly, the transfer jam detecting apparatus also has a sensor for sensing the point where the printed matter enters the transfer roll.

The conventional transfer jam detecting apparatus described above has the advantage of easily detecting the presence of certain kinds of jams by the sensor which senses if the printed matter reaches the desired position in a given time after the printed matter enters into the transfer roll. The conventional transfer jam detecting apparatus, however, has a shortcoming in not detecting the presence of some kinds of jams such as wrap jams, in which the middle portion of the printed matter is wrapped in the transfer roll or the fuser roll after the normal exit of the printed matter. When a wrap jams occur, the printed matter may be wrapped further into the cleaning roll, resulting in a serious error in the related parts of the printer. Further, the un-jamming process is complex.

Also, with the conventional transfer jam detecting apparatus, the printed matter is often wrapped into the cleaning roll, since there is a small difference between the distance (hereinafter called 'normal distance') that the printed matter travels during normal operation, compared to the distance (hereinafter briefly called 'abnormal distance') that the printed matter travels when wrapped in the transfer roll before being wrapped in the cleaning roll. The normal distance is expressed by the distance of the vertical line from the nip of the transfer roll to the first detecting lever, which is approximately 35 mm in the conventional apparatus, while the abnormal distance is expressed by the distance of a circular arc of the transfer roll starting from the nip of the transfer roll to the point of the transfer roll making contact with the cleaning roll, which is approximately 38 mm in the conventional apparatus. Accordingly, the difference between the normal distance (35 mm) and the abnormal distance (38 mm) is approximately 3 mm, which is quite small. Since there is a small difference between the normal and abnormal distances, it often occurs that the printed matter is allowed to advance into the cleaning roll even after detecting abnormality of the exit of the printed matter. Once the printed matter is wrapped in the cleaning roll, the user can not remove the printed matter easily.

Further, the parts of the conventional transfer jam detecting apparatus are disposed on different units, that is, the first detecting lever is attached to frame of the transferring/fixing unit, while the second detecting lever and the sensor are attached to a frame of a distributing unit. Such a dual operational structure causes difficulty in maintaining accuracy, and unreliability in operation of the printer such as unsmooth return of the detecting lever, etc.

Further, in the conventional transfer jam detecting apparatus, the sensor is disposed near the center of the fuser roll which is very hot. Accordingly, a high temperature sensor is required, and the manufacturing cost increases.

SUMMARY OF THE INVENTION

It is therefore an object of the present invention to provide an improved transfer jam detecting apparatus of a wet type electrophotographic printer.

It is also an object of the invention to provide a transfer jam detecting apparatus which can detect all types of transfer jams.

Another object of the invention is to provide an apparatus which can prevent a wrap jam.

Yet another object of the invention is to provide an apparatus which avoids errors in printer operation due to transfer jams.

Still another object of the invention is to provide a transfer jam detecting apparatus which is more accurate and reliable.

A further object is to provide a transfer jam detecting apparatus which does not have parts disposed on different units.

Still another object of the invention is to provide a transfer jam detecting apparatus not requiring a sensor which can tolerate high temperature.

Yet another object of the invention is to provide a transfer jam detecting apparatus which is less expensive.

The present invention has been made to overcome the above described problems of the related art, and accordingly provides a transfer jam detecting apparatus for a wet type electrophotographic color printer capable of detecting every kind of transfer jam, even a wrap jam in which the middle portion of printed matter is wrapped in the transfer roll or the fuser roll, and accordingly stopping the operation of the printer. The invention provides a transfer jam detecting apparatus for a wet type electrophotographic color printer capable of basically preventing the rolling of the printed matter which is caused due to a short distance margin between the normal and abnormal distances sensed by a sensor, by maintaining enough marginal distance between the normal and abnormal distances.

The above objects are accomplished by a transfer jam detecting apparatus for a wet type electrophotographic color printer according to the present invention, which includes: a printed matter entrance sensor disposed on a front side of a transfer roll, for detecting an entrance of a printed matter into the transfer roll; a feed roll disposed by a shaft to be rotated in either direction on a transfer section printed matter guide disposed on a rear side of the transfer roll, the feed roll being passively rotated by the conveyed printed matter; a pressing roll assembly disposed on an upper portion of the feed roll, for pressing the printed matter in a manner that the feed roll is passively rotated by the conveyed printed matter; and feed roll rotational direction detecting means for detecting the presence of a jam by detecting the rotation and rotational direction of the feed roll.

Here, the feed roll rotational direction detecting means includes: a rotational plate disposed on the shaft of the feed roll and having a plurality of sensing holes; and a sensor disposed to receive the sensing holes of the rotational plate, for detecting the rotation and rotational direction of the rotational plate.

The rotational plate is rotated in the same direction as the feed roll which is passively rotated by the conveyed printed matter, and the sensor senses the rotation and rotational direction of the rotational plate within a certain period of time after the entrance of the printed matter into the transfer roll, thereby sensing whether the exit of the printed matter is normal, or abnormal.

More specifically, after the entrance of the printed matter into the transfer roll, when the printed matter is rotated in the same direction as the direction of the exit of the printed matter after a certain period of time, it is sensed that the printed matter exits normally. When the rotational plate is not rotated after the certain period of time, however, it is sensed that a certain kind of jam, in which the printed matter is wrapped around the transfer roll or the fuser roll, occurs, so that the printer stop signal is transmitted to the control section. Further, when the rotational plate is rotated reversely after the normal rotation, it is sensed that the wrap jam, in which the middle portion of the printed matter is wrapped around the transfer roll or the fuser roll, occurs, so that the stop signal is transmitted to the control section.

As described above, according to the present invention, all kinds of jams occurring at the transfer roll can be precisely detected, and the printer can be timely stopped, while the occurrence of the jam is communicated to a user. Accordingly, a serious error in parts of the printer caused due to the wrap jam can be prevented, and the user is enabled to remove the jammed printed matter easily and timely.

Meanwhile, according to the preferred embodiment of the present invention, the feed roll is comprised of at least three rolls which are disposed on the same shaft to be simultaneously rotated. Further, the pressing roll assembly includes: a fuser section printed matter guide disposed on a rear side of the fuser roll; a pressing roll rotatably disposed on the fuser section printed matter guide by a shaft; and a spring disposed between the pressing roll and the fuser section printed matter guide, for elastically biasing the pressing roll downward. The pressing roll may have the same number of rolls as that of the feed roll.

Further, the sensing holes of the rotational plate are shaped as rectangles of a certain size, or as rectangles which successively increase in size.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
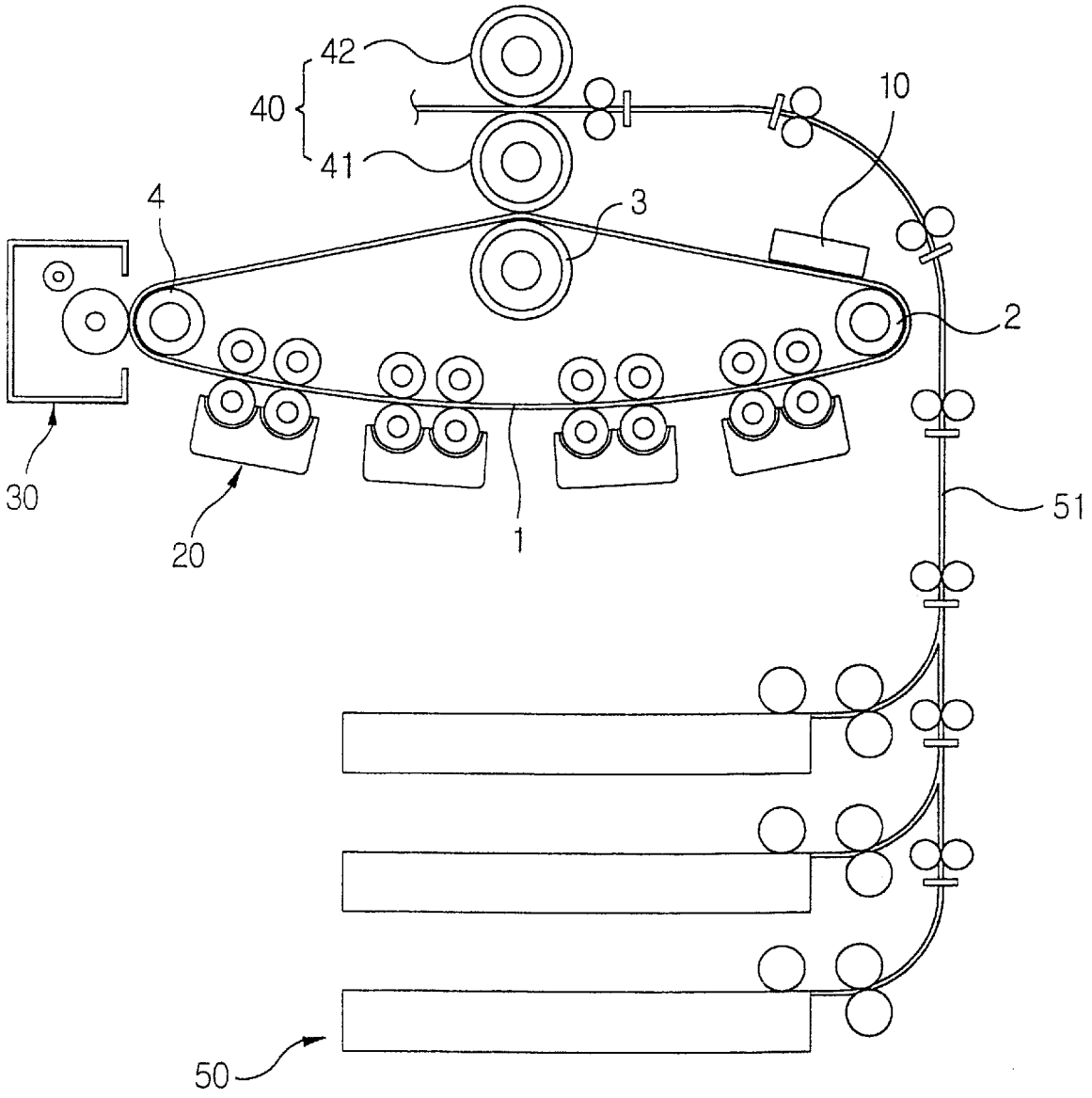
FIG. 1 (PRIOR ART)
FIG. 1 is a view for schematically showing the structure of a conventional wet type electrophotographic color printer.

Turning now to the drawings, a wet type electrophotographic color printer is schematically shown in FIG. 1, which will be described briefly below. As shown in FIG. 1, the printer includes a photosensitive material 1 in the form of a belt reeled to travel on rollers 2, 3, and 4 which are disposed within a printer body (not shown). Around the photosensitive material 1, a charged unit 10, an exposure unit (not shown), a developing unit 20, a drying unit 30, and a transferring/fixing unit 40, etc., are disposed.

The electrostatic latent image is formed on the photosensitive medium, to be developed by the developing unit 20. The developing unit 20 develops the electrostatic latent image on the surface of the photosensitive medium 1 by jetting the developing liquid, and exclusively retaining the toner of the developing liquid at the area of electrostatic latent image. The drying unit 30 eliminates residue of the carrier left from the operation of the developing unit 20, to an extent acceptable for the transferring operation. The transferring/fixing unit 40 transfers the image formed on the photosensitive medium 1 onto the printed matter.

The printed matter is stored in a plurality of cassettes in accordance with the respective sizes and kinds thereof, and is fed to the transferring/fixing unit 40 along a feeding path 51. After the image is printed on the printed matter which is passed through the transferring/fixing unit 40, the printed matter is stored in a distributing tray (not shown).

Figure 2:
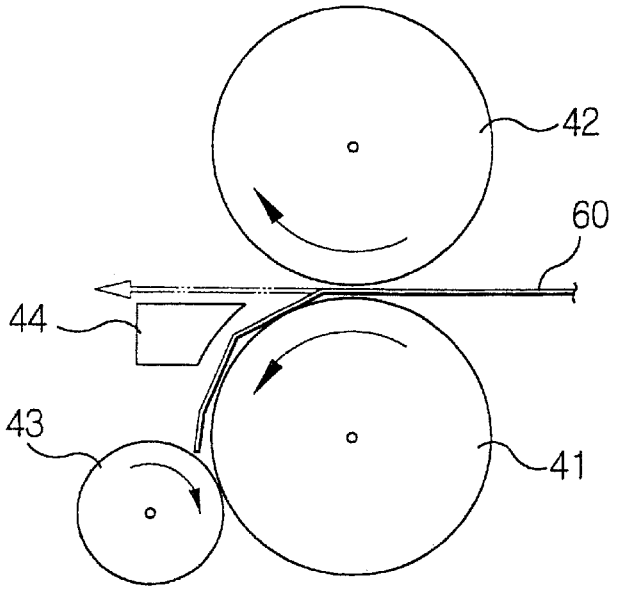
FIG.2 (PRIOR ART)
FIGS. 2 to 7 are views for showing various kinds of transfer jams occurring in a conventional wet type electrophotographic color printer.
Figure 3:
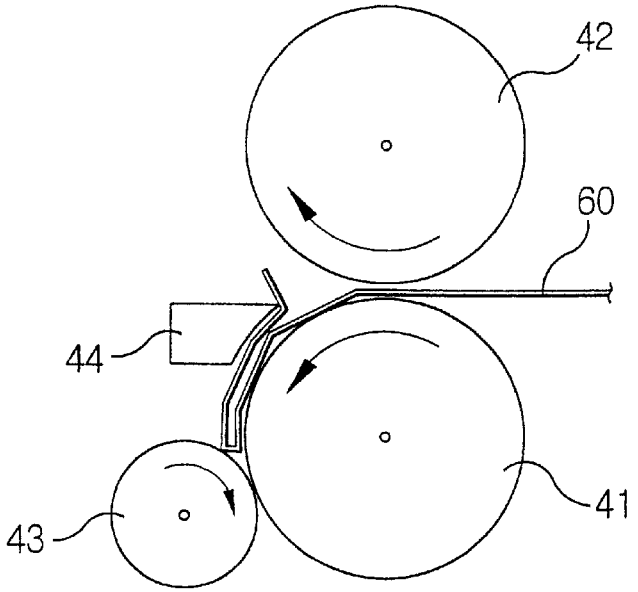
FIG.3 (PRIOR ART)
Figure 4:
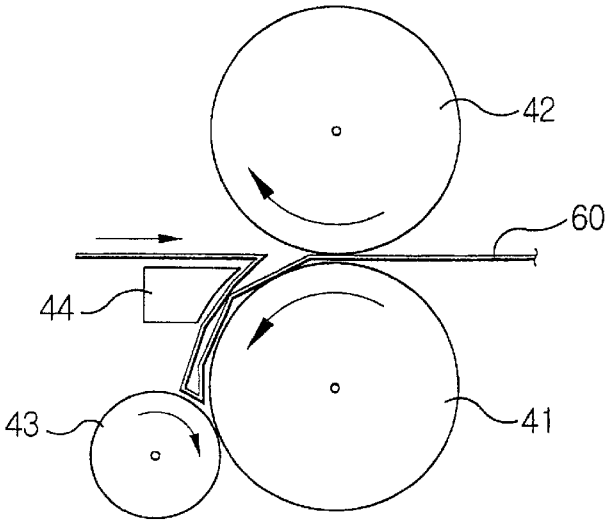
FIG.4 (PRIOR ART)
Figure 5:
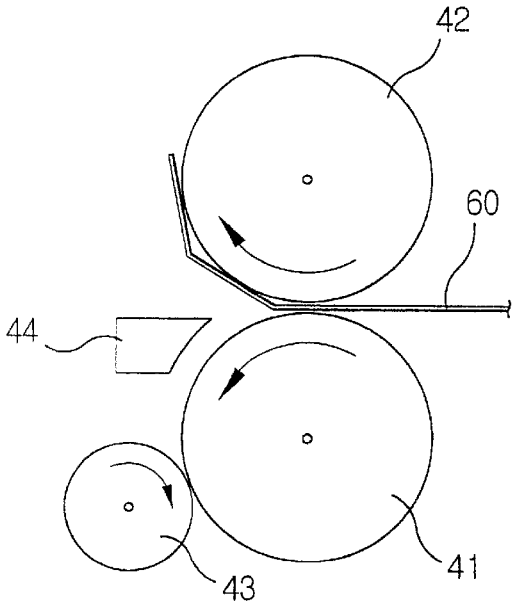
FIG.5 (PRIOR ART)
Figure 6:
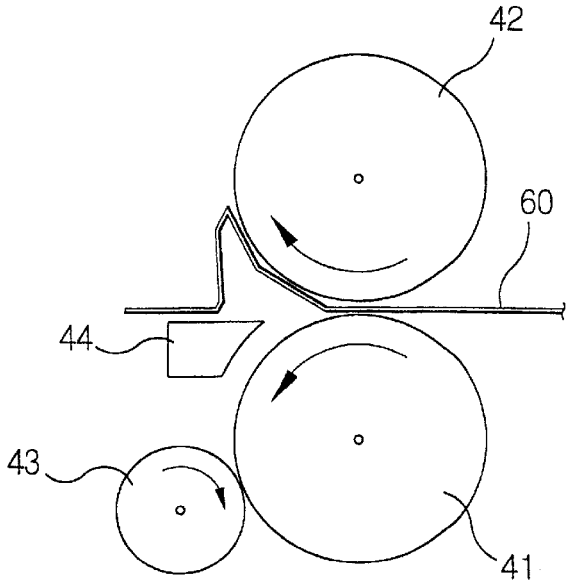
FIG.6 (PRIOR ART)
Figure 7:
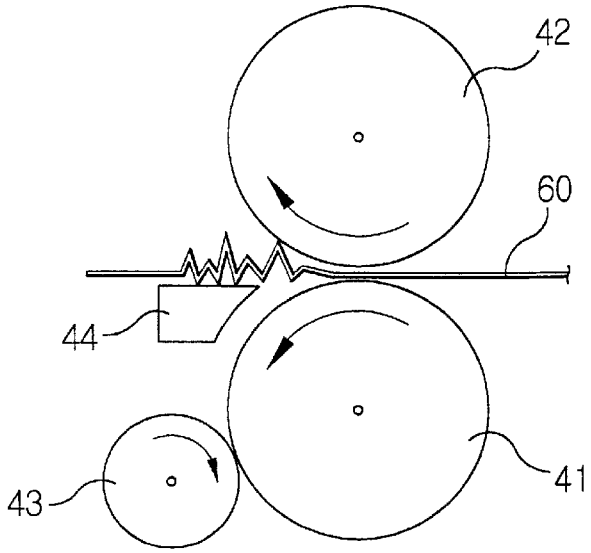
FIG.7 (PRIOR ART)

Here, while the printed matter is passed between the transfer and fuser rolls 41 and 42, various kinds of transfer jams as shown in FIGS. 2 to 7 may occur, that is, the printed matter may be wrapped around the transfer and fuser rolls 41 and 42 due to various causes such as peel force increase in the transfer and fuser rolls 41 and 42, or a stain on the transfer and fuser rolls 41 and 42, etc. More specifically, the jams shown in FIGS. 2 and 3 are caused due to the peel force increase in the transfer roll 41, a stain on the front portion of the printed image, or an abnormality of the front margin of the printed matter, while the jam shown in FIG. 4 is caused due to the peel force increase in the transfer roll 41, or an abnormality of the middle portion of the image. Further; the jams shown in FIGS. 5 and 6 are caused due to the peel force increase in the fuser roll 42, or a stain at the fuser roll 42, while the jam shown in FIG. 7 is caused due to the presence of foreign substance on the printed matter feeding path. In FIGS. 2 to 7, a reference numeral 43 refers to a cleaning roll, and 44 is a transfer section printed matter guide. Further, the reference numeral 60 is a printed matter.

When the above-described transfer jams occur, the printing is not properly performed due to the crumpled exit of the printed matter 60. Even worse, if the printer keeps operating in the state where the printed matter 60 is wrapped around the transfer and fuser rolls 41 and 42, a serious error will result in the photosensitive material 1, the transfer roll 41, the fuser roll 42, and the photosensitive material driving section. In order to prevent such an error, the wet type electrophotographic color printer generally has a transfer jam detecting apparatus for stopping the operation of the printer upon detecting the presence of the transfer jam.

Figure 8:
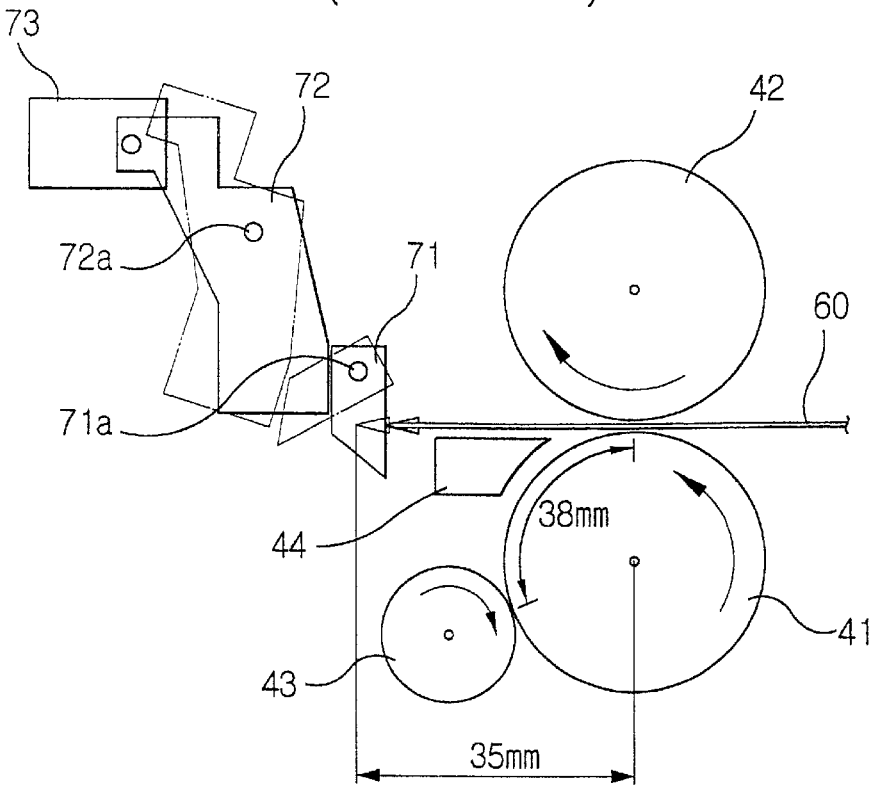
FIG.8 (PRIOR ART)
FIG. 8 is a view for showing the structure and operation of the transfer jam detecting apparatus for a conventional wet type electrophotographic color printer.

FIG. 8 shows an example of a conventional transfer jam detecting apparatus. As shown in at FIG. 8, the conventional transfer jam detecting apparatus includes a first detecting lever 71, which can rotate in a forward or reverse direction, disposed on the printed matter conveying path after the transfer and fuser rolls 41 and 42, a second detecting lever 72 which rotates in accordance with the rotation of the first detecting lever 71, and a sensor 73 which is turned on/off in accordance with the rotation of the second detecting lever 72.

Here, the first detecting lever 71 is rotated clockwise on a pin 71*a*, by making contact with the front end of the printed matter 60, thereby rotating clockwise the second detecting lever 72 on a pin 72*a* . After the clockwise rotation, the first and second detecting levers 71 and 72 are returned to their initial position by their respective weights. The sensor 73 is turned on by the rotation of the second detecting lever 72, thereby sensing the normal exit of the printed matter. If the sensor 73 is not turned on by a certain period of time after the entrance of the printed matter 60 into the transfer roll 41, it is sensed that a jam has occurred, and a signal is transmitted to a control section (not shown) for stopping the operation. Accordingly, the transfer jam detecting apparatus also has a sensor for sensing the point where the printed matter 60 enters the transfer roll 41, which is not shown in the drawings.

The conventional transfer jam detecting apparatus described above has the advantage of easily detecting the presence of certain kinds of jams shown in FIGS. 2, 3, 5, and 7, by the sensor 73 which senses if the printed matter 60 reaches the desired position in a given time after the printed matter 60 enters into the transfer roll 41. The conventional transfer jam detecting apparatus, however, has a shortcoming in not detecting the presence of some kinds of jams such as wrap jams shown in FIGS. 4 and 6, in which the middle portion of the printed matter is wrapped in the transfer roll 41 or the fuser roll 42 after the normal exit of the printed matter 60. When a wrap jams occur, the printed matter 60 may be wrapped further into the cleaning roll 43, resulting in a serious error in the related parts of the printer. Further, the un-jamming process is complex.

Also, with the conventional transfer jam detecting apparatus, the printed matter 60 is often wrapped into the cleaning roll 43, since there is a small difference between the distance (hereinafter called 'normal distance') that the printed matter travels during normal operation, compared to the distance (hereinafter briefly called 'abnormal distance') that the printed matter travels when wrapped in the transfer roll 41 before being wrapped in the cleaning roll 43. The normal distance is expressed by the distance of the vertical line from the center of the transfer roll 41 to the first detecting lever 71 (approximately 35 mm), while the abnormal distance is expressed by the distance of a circular arc of the transfer roll 41 starting from a certain point of the transfer roll 41 to the point of the transfer roll 41 making contact with the cleaning roll 43 (approximately 38 mm). Accordingly, the difference between the normal distance (35 mm) and the abnormal distance (38 mm) is approximately 3 mm, which is quite small. Since there is a small difference between the normal and abnormal distances, it often occurs that the printed matter 60 is allowed to advance into the cleaning roll 43 even after detecting abnormality of the exit of the printed matter 60. Once the printed matter 60 is wrapped in the cleaning roll 43, the user can not remove the printed matter 60 easily.

Further, the parts of the conventional transfer jam detecting apparatus are disposed on different units, that is, the first detecting lever 71 is attached to a frame of the transferring/fixing unit 40, while the second detecting lever 72 and the sensor 73 are attached to a frame of a distributing unit. Such a dual operational structure causes difficulty in maintaining accuracy, and unreliability in operation of the printer such as unsmooth return of the detecting lever, etc.

Further, in the conventional transfer jam detecting apparatus, the sensor 73 is disposed near the center of the fuser roll 42 which is very hot. Accordingly, a high temperature sensor is required, and the manufacturing cost increases.

Reference will now be made in detail to the present preferred embodiment of the present invention, examples of which are illustrated in the accompanying drawings, wherein like reference numerals refer to the like elements throughout. The embodiments are described below in order to explain the present invention by referring to the figures.

Figure 9:
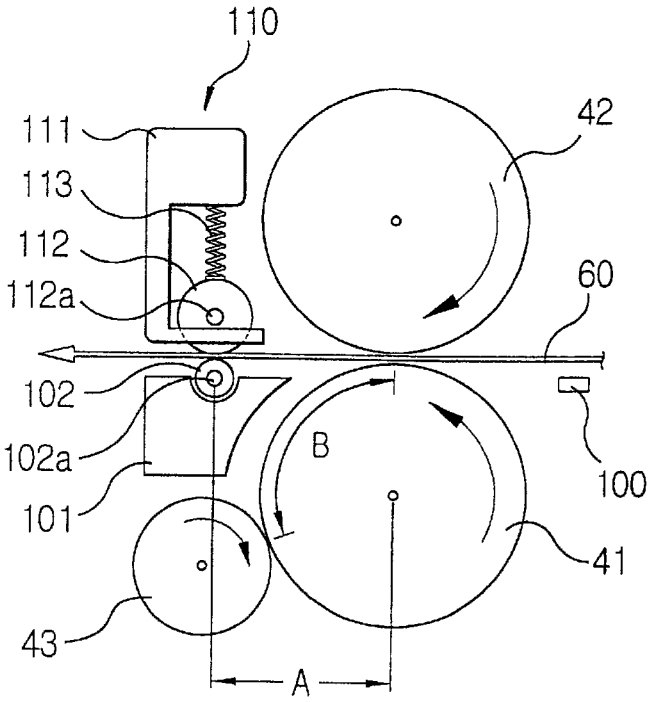
FIG. 9 is a view for showing the structure and operation of the transfer jam detecting apparatus for a wet type electrophotographic color printer according to a preferred embodiment of the present invention.
Figure 10:
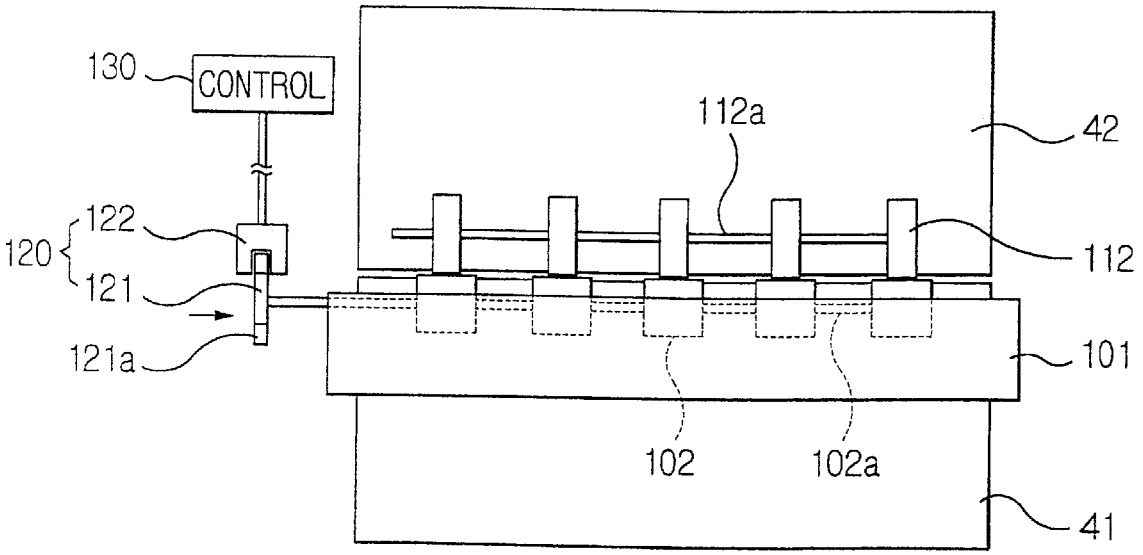
FIG. 10 is a side view of FIG. 9.
Figure 11A:
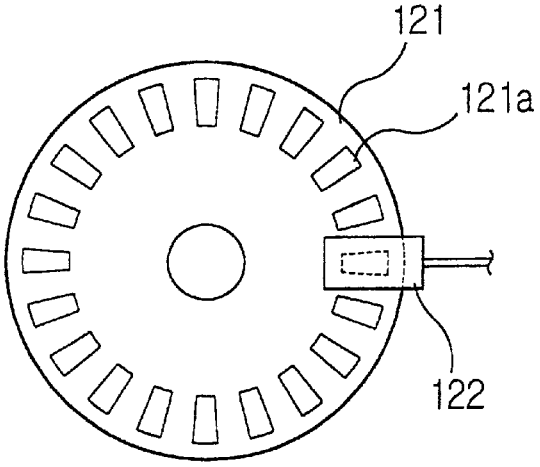
FIGS. 11A and 11B are front views of different examples of rotational plates.
Figure 11B:
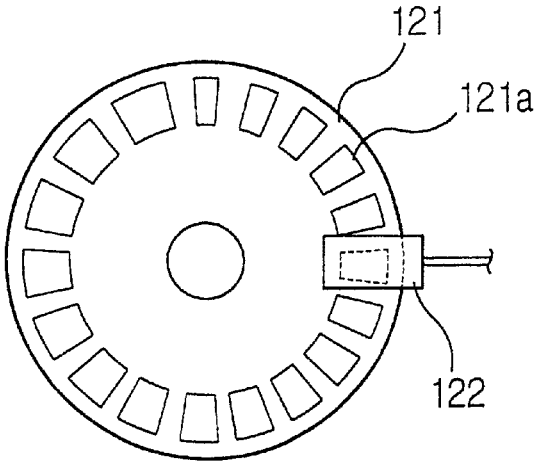

FIG. 9 is a view for showing the structure and operation of a transfer jam detecting apparatus for a wet type electrophotographic color printer according to a preferred embodiment of the present invention, FIG. 10 is a side view of FIG. 9, and FIGS. 11A and 11B are front views of different examples of rotational plates.

As shown, the transfer jam detecting apparatus for a wet type electrophotographic color printer according to the present invention includes a printed matter entrance sensor 100 disposed on the front sides of the transfer roll 41 and a fuser roll 42 to detect the entrance of the printed matter 60 into the transfer roll 41, a plurality of feed rolls 102 disposed by a shaft 102*a* to be rotated in either direction on the transfer section printed matter guide 101 disposed on the rear side of the transfer roll 41, a pressing roll assembly 110 on the upper portion of the feed roll 102, for pressing the printed matter 60 in a manner that the feed rolls 102 are passively rotated by the printed matter 60, and feed roll rotational direction sensor 120 for detecting the presence of a jam by detecting the rotation and rotational direction of the feed rolls 102.

The feed rolls 102 may either be comprised of several rolls as shown in this embodiment, or may be comprised of one roll. When the feed rolls 102 are comprised of several rolls, the rolls 102*a* should be disposed on one shaft 102*a*. Here, the number of feed rolls 102 is preferably from 3 to 5, but not strictly limited thereto.

The pressing roll assembly 110 includes a fuser section printed matter guide 111 disposed on the rear side of the fuser roll 42, a pressing roll 112 rotatably disposed on the fuser section printed matter guide 111 by a shaft 112*a*, and a spring 113 disposed between the pressing roll 112 and the printed matter guide 111 to elastically bias the guide roll 112 downward. Here, the pressing roll 112 may be comprised of the same number of rolls as that of the feed rolls 102, but it is not strictly limited thereto, and the pressing roll 112 may be comprised of one roll.

Meanwhile, the feed roll rotational direction sensor 120 is disposed on the same shaft 102*a* of the feed rolls 102 to be rotated together with the feed rolls 102. The feed roll rotational direction sensor 120 includes a rotational plate 121 having a plurality of sensing holes 121*a* which are spaced from each other at a certain distance, and a sensor 122 disposed to receive the sensing holes 121*a* of the rotational plate 121, to detect the rotation and the rotational direction of the rotational plate 121. As shown in FIG. 11A, the sensing holes 121*a* may be squares or approximately rectangular in shape, and may be of a certain size, or as shown in FIG. 11B, the sensing holes 121*a* may be rectangles or squares which successively increase in size around the rotational plate.

The sensor 122 conveys signals detected at the rotational plate 121 to a control section 130, and the control section 130 determines the presence and the kind of the jam in accordance with the inputted signal from the sensor 122, and accordingly stops the operation of the printer when the presence of a jam is determined.

The operation of the transfer jam detecting apparatus constructed as above according to the present invention will be described in greater detail below. After the entrance of the printed matter 60 into the transfer roll 41, the printed matter 60 is passed between the feed rolls 102 and the pressing rolls 112, and when it is a normal operation, the feed rolls 102 are passively rotated by the printed matter 60 in a certain direction where the printed matter 60 is moved to exit.

Accordingly, the rotational plate 121 is rotated in the same direction as the feed rolls 102, and the rotation of the rotational plate 121 is detected by the sensor 122. The sensor 122 conveys the detected signal to the control section 130, and the control section 130 determines that the printed matter 60 exits in normal condition.

Meanwhile, when the rotation of the rotational plate 121 is not detected in a given period of time after the printed matter 60 enters into the transfer roll 41, the control section 130 determines that the printed matter 60 is wrapped around the transfer roll 41, or around the fuser roll 42, i.e., the control section 130 determines the jam shown in FIGS. 2, 3, 5, and 7 has occurred; and accordingly stops the operation of the printer. Here, in addition to stopping the operation of the printer, the control section 130 also generates a notice to a user that the jam has occurred. Accordingly, the user is enabled to remove the jammed printed matter in a timely manner.

Further, when the rotational plate 121 is stopped or reversely rotated after the normal rotation after the entrance of the printed matter 60 into the transfer roll 41, the control section 130 determines that the wrap jam shown in FIGS. 4 and 6 has occurred in accordance with the detected signal from the sensor 122, and accordingly stops the operation of the printer. Unlike the conventional transfer jam detecting apparatus which is capable of detecting certain limited kinds of the transfer jams, the transfer detecting apparatus according to the present invention is capable of detecting all kinds of transfer jams precisely, particularly the wrap jam, by detecting the rotation and rotational direction of the feed rolls 102. Accordingly, even when the wrap jam occurs, the printer is timely stopped.

As described above, according to the present invention, all kinds of jams occurring at the transfer roll can be precisely detected, and the printer can be timely stopped, while the occurrence of the jam is communicated to a user. Accordingly, a serious error in parts of the printer caused due to the wrap jam can be prevented, and the user is enabled to remove the jammed printed matter easily and timely.

Further, in a transfer jam detecting apparatus according to the present invention, since the sensing part is constructed on the transfer section printed matter guide which is positioned near the transfer roll, the normal distance, A, is reduced to less than half of the abnormal distance, B. Specifically, in the present invention, the normal distance A is the distance from the nip between fuser roll 42 and transfer roll 41 to the nip between feed roll 102 and pressing roll 112. The abnormal distance B is the distance along the circumference of transfer roll 41 from the nip between fuser roll 42 and transfer roll 41 to the nip between cleaning roll 43 and transfer roll 41. In one embodiment of the present invention, the normal distance A is approximately 16 mm and the abnormal distance B is approximately 38 mm. Accordingly, a sufficient margin is guaranteed between the normal and abnormal distances A and B, and the wrapping of printed matter on the cleaning roll is basically prevented.

Further, in the transfer jam detecting apparatus according to the present invention, since the wrap jam is rapidly and precisely detected, the printer is timely stopped. Accordingly, the printed matter is not damaged even when the wrap jam occurs, and the user is enabled to remove the wrap-jammed printed matter as simply as he/she removes the other jammed printed matter.

Further, since the transfer jam detecting apparatus according to the present invention is designed to have a simple structure, reliability in operation is guaranteed. Further, since the sensor is not disposed in the hot temperature middle portion of the fuser roll, but rather on an outer side of the end of the fuser roll due to the use of the shaft, there is no need to employ a high-priced hot temperature-tolerant sensor. Accordingly, the manufacturing cost is reduced.

As stated above, the preferred embodiment of the present invention is shown and described. Although the preferred embodiment of the present invention has been described, it is understood that the present invention should not be limited to this preferred embodiment but various changes and modifications can be made by one skilled in the art within the spirit and scope of the present invention as hereinafter claimed.

What is claimed is:

1. A transfer jam detecting apparatus of a wet type electrophotographic printer, comprising:

a transfer roll mounted along a printed matter path of the printer;

a fuser roll contacting the transfer roller;

a printed matter entrance sensor disposed on a front side of the transfer roll and fuser roll, for detecting the entry of printed matter to the transfer roll and fuser roll;

a transfer section printed matter guide disposed on the rear side of the transfer roll and fuser roll;

a first shaft disposed near the transfer section printed matter guide and perpendicular to the path of printed matter exiting the transfer roll and fuser roll;

a feed roll mounted on the first shaft;

a feed roll rotational sensor connected to said first shaft for detecting the rotation of the feed roll; and a pressing roll assembly comprising a rotatable pressing roll contacting said feed roll.

2. The apparatus of claim 1, further comprising:

a controller connected to said printed matter entrance sensor and feed roll rotational sensor, for detecting the entrance of printed matter to the transfer and fuser rolls and the rotation of the feed roll upon entry of printed matter between the pressing roll and feed roll.

3. The apparatus of claim 2, further comprising:

said controller having means for determining the direction of rotation of said feed roll.

4. The apparatus of claim 1, said feed roll rotational sensor further comprising:

a rotational plate having sensing holes formed therein mounted on said first shaft; and a hole sensor mounted along a side of the rotational plate for detecting the passage of the holes of the rotational plate.

5. The apparatus of claim 4, further comprising:

a controller connected to said printed matter entrance sensor and feed roll rotational sensor, for detecting the entrance of printed matter to the transfer and fuser rolls and the rotation of the feed roll upon entry of printed matter between the pressing roll and feed roll.

6. The apparatus of claim 4, said holes being approximately rectangular in shape.

7. The apparatus of claim 4, said holes being all of the same size.

8. The apparatus of claim 4, said holes increasing successively in size around the rotational plate.

9. The apparatus of claim 8, further comprising:

a controller connected to said printed matter entrance sensor and feed roll rotational sensor, for detecting the entrance of printed matter to the transfer and fuser rolls, detecting the rotation of the feed roll upon entry of printed matter between the pressing roll and feed roll, and detecting the direction of rotation of the feed roll by timing of the passage of the differently sized sensor holes.

10. The apparatus of claim 1, further comprising:

a plurality of feed rolls mounted along said first shaft.

11. The apparatus of claim 10, further comprising:

a plurality of pressing rolls, each pressing roll contacting one of said feed rolls.

12. The apparatus of claim 1, said pressing roll assembly further comprising:

a fuser section printed matter guide disposed on the opposite side of the printed matter path from said transfer section printed matter guide;

a second shaft axially supporting said pressing roll; and a spring connected to said fuser section printed matter guide and said second shaft for biasing the pressing roll toward said feed roll.

13. The apparatus of claim 1, further comprising:

a cleaning roll contacting said transfer roll;

the distance from the nip between said fuser roll and transfer roll to the nip between said feed roll and pressing roll being less than approximately one-half of the distance along the circumference of said transfer roll from the nip between said fuser roll and transfer roll to the nip between said cleaning roll and transfer roll.

14. The apparatus of claim 13, further comprising:

the distance from the nip between said fuser roll and transfer roll to the nip between said feed roll and pressing roll being approximately 16 mm; and the distance along the circumference of said transfer roll from the nip between said fuser roll and transfer roll to the nip between said cleaning roll and transfer roll being approximately 38 mm.

15. A method of detecting a transfer jam of a wet type electrophotographic printer, comprising the steps of:

positioning a feed roll connected to a rotational sensor and a pressing roll pressing against the feed roll at the rear side of a transfer roll and fuser roll of the printer;

detecting the entry of printed matter between the transfer roll and fuser roll using an entry sensor disposed on the front side of the transfer roll and fuser roll; and when printed matter passes the entry sensor and the rotational sensor does not detect the rotation of the feed roll within a predetermined amount of time after the printed matter passes the entry sensor, then determining that a jam has occurred.

16. The method of claim 15, the distance from the nip between said fuser roll and transfer roll to the nip between said feed roll and pressing roll being less than approximately one-half of the distance along the circumference of said transfer roll from the nip between said fuser roll and transfer roll to the nip between a cleaning roll and said transfer roll.

17. The method of claim 15, further comprising the step of:

when it is determined that a jam has occurred, stopping the operation of the printer.

18. A method of detecting a transfer jam in a of a wet type electrophotographic printer, comprising the steps of:

positioning a feed roll connected to a rotational sensor and a pressing roll pressing against the feed roll at the rear side of a transfer roll and fuser roll of the printer; and when the rotational sensor detects that the feed roll is rotating in the direction opposite to the normal rotation direction, determining that a jam has occurred.

19. The method of claim 18, further comprising the step of:

when it is determined that a jam has occurred, stopping the operation of the printer.

* * * * *